US008025778B2

(12) United States Patent
Bagatavicius et al.

(10) Patent No.: US 8,025,778 B2
(45) Date of Patent: Sep. 27, 2011

(54) CATHODIC PROTECTION APPARATUS AND METHOD

(75) Inventors: Paul Bagatavicius, Ontario (CA); Sorin Segall, Ontario (CA)

(73) Assignee: Corrosion Service Company Limited, Ontario (CA)

( * ) Notice: Subject to any disclaimer, the term of this patent is extended or adjusted under 35 U.S.C. 154(b) by 199 days.

(21) Appl. No.: 12/285,813

(22) Filed: Oct. 15, 2008

(65) Prior Publication Data

US 2009/0145748 A1 Jun. 11, 2009

(30) Foreign Application Priority Data

Oct. 16, 2007 (CA) ..... 2606671

(51) Int. Cl.
*C23F 13/06* (2006.01)
*C23F 13/10* (2006.01)

(52) U.S. Cl. ..... 204/196.2; 204/196.21; 204/196.33; 204/196.34; 204/196.35; 204/196.36; 204/196.37

(58) Field of Classification Search ..... 204/196.01, 204/196.11, 196.2, 196.21, 196.26, 196.33, 204/196.36, 196.37, 196.34, 196.35
See application file for complete search history.

(56) References Cited

U.S. PATENT DOCUMENTS 5,065,893 A 11/1991 Kroon et al.
5,340,455 A * 8/1994 Kroon et al. ..... 204/196.3
5,411,646 A * 5/1995 Gossett et al. ..... 205/724

* cited by examiner

*Primary Examiner* — Bruce Bell
(74) *Attorney, Agent, or Firm* — Harness, Dickey & Pierce, P.L.C.

(57) ABSTRACT

In combination, a storage tank having a metal bottom, compacted electrolytic backfill below the tank bottom and a cathodic protection anode within the backfill below the tank bottom. The anode is in the form of a generally continuous ribbon that is shaped to follow a serpentine path corresponding generally in shape to the tank bottom. A feeding cable network is connected directly to the anode.

33 Claims, 3 Drawing Sheets

CATHODIC PROTECTION APPARATUS AND METHOD

FIELD OF THE INVENTION

The present invention relates generally to corrosion protection and in particular, to a cathodic protection apparatus and storage tank incorporating the same.

BACKGROUND OF THE INVENTION

Exterior metal structures including but not limited to above-ground storage tanks which are supported on the ground, are subject to corrosion especially the portions of the metal structures in close proximity to the ground. As will be appreciated, in the case of exterior storage tanks, the tank bottoms can become moist and remain moist as a result of ground moisture, under-tank condensation or seam leakage. It is important to protect tank bottoms from corrosion in order to preserve assets, reduce maintenance costs, reduce inspection costs, often as a regulatory requirement, and to preserve the environment.

As is well known, cathodic protection is a technique to control the corrosion of a metal surface by making that surface the cathode of an electrochemical cell i.e. the application of direct current to reverse the natural tendency for metals to return to their natural condition as metal oxides (rust). Many cathodic protection systems to prevent corrosion of metal structures have been considered.

New and rebuilt ground storage tanks make use of an environmental safety secondary containment liner in the form of a plastic membrane that is spaced a short distance beneath the metal tank bottom and supported on compacted earth. The secondary containment liner is designed to contain leaks to prevent ground contamination. Unfortunately, because of the dielectric properties of the secondary containment liner, conventional and widely accepted cathodic protection methods, such as those using remote deep anodes or distributed anodes around the tank are not effective for use with such new and rebuilt storage tanks. Placing the anodes outside the secondary containment liner does not work as the dielectric secondary containment liner effectively blocks the required current flow from such anodes to the tank bottom. As a result, to be effective, the anodes have to be placed in the relatively narrow space between the secondary containment liner and the tank bottom.

Galvanic cathodic protection systems making use of zinc or magnesium ribbon anodes have also been considered. The galvanic ribbon anodes are typically installed in parallel lengths between the secondary containment liner and the tank bottom floor. Although effective, because of the large volume of anode material required to cover fully the tank bottom, these cathodic protection systems have proven to be quite costly for large diameter tanks. In addition, the life of such galvanic cathodic protection systems is limited and usually not commensurate with the design life of the storage tank.

In cathodic protection systems, it is important for the anode to be uniformly spaced from the tank bottom. If the anode is not substantially uniformly spaced from the tank bottom, a near short may occur resulting in non-uniform distribution of the protective current in the tank bottom resulting in the storage tank being prone to corrosion. It is also important that the anode not touch the tank bottom. If the anode touches the tank bottom, a short will occur resulting in malfunction of the cathodic protection system.

The area beneath a large ground storage tank is difficult to access making repairs within that area virtually impossible. It is, therefore, important to use anode materials which do not themselves substantially corrode, or which do not form current blocking oxidation layers. Further, the anode and the connections to the anode should provide a thin or low profile and should also be such that the cathodic protection system provides a minimal protection current substantially uniformly to the entire tank bottom.

U.S. Pat. No. 5,065,893 to Kroon et al. discloses a cathodic protection system for an above-ground storage tank having a metal bottom. A leak containing dielectric safety membrane is spaced a short distance below and extends beneath the tank bottom generally parallel thereto thereby to form a narrow envelope. Compacted electrolytic fill is provided between the dielectric safety membrane and the tank bottom. A horizontally disposed cathodic protection anode is embedded in the electrolytic fill. The anode is in the form of a matrix or grid of interconnected titanium bars and ribbons. A reticulate dielectric insulator may be embedded in the electrolytic fill and positioned directly above the anode to maintain a generally uniform spacing between the anode and the tank bottom. The ribbons extend transversely of the bars and are spot welded on uniform centers to the bars on diameters or major chords of a circular tank bottom. A low profile connection is provided between the bars and power feeds to a rectifier. Although this cathodic protection system has proven to be effective, improvements to such cathodic protection systems are desired.

It is therefore an object of the present invention to provide a novel cathodic protection apparatus and storage tank incorporating the same.

SUMMARY OF THE INVENTION

Accordingly, in one aspect there is provided a cathodic protection apparatus comprising:

a generally continuous anode to be disposed adjacent a surface to be protected, said anode being in the form of a ribbon that is shaped to follow a generally serpentine path; and a feeding cable network to couple said anode to a source of power.

In one embodiment, the ribbon is shaped to conform generally to the shape of the surface to be protected. The ribbon may follow a zig-zag pattern to define major ribbon runs joined by minor ribbon runs. Additional current paths may bridge adjacent shorter major ribbon runs. The feeding cable network comprises a plurality of feeding cables with each feeding cable being connected to a plurality of major ribbon runs. Connections of different feeding cables to the same major ribbon run are spaced a distance to achieve generally uniform current distribution in that major ribbon run. The ribbon in one form is a mixed metal oxide ribbon.

According to another aspect there is provided in a combination, a storage tank having a metal bottom, compacted electrolytic backfill below the tank bottom and a cathodic protection anode within the backfill below the tank bottom, said anode being in the form of a generally continuous ribbon that is shaped to follow a generally serpentine path corresponding generally in shape to the tank bottom.

BRIEF DESCRIPTION OF THE DRAWINGS

Embodiments will now be described more fully with reference to the accompanying drawings in which.

DETAILED DESCRIPTION OF THE EMBODIMENTS

Figure 1:
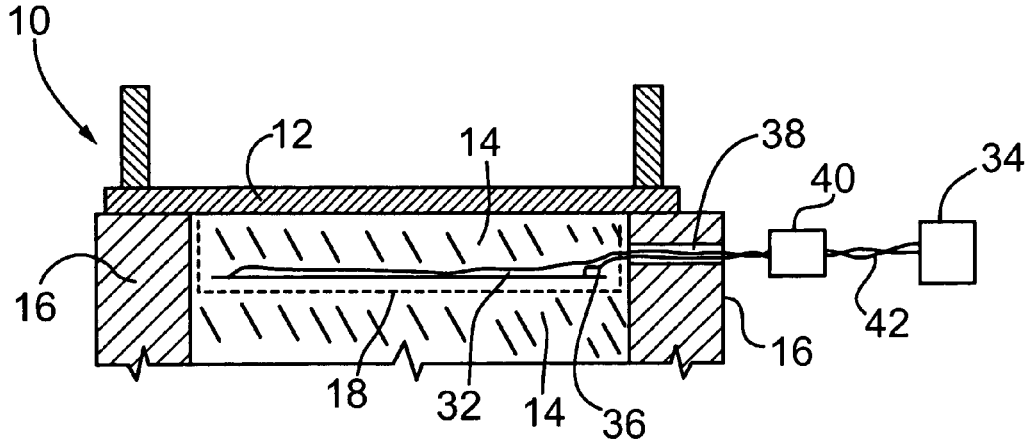
FIG. 1 is a side view, partly in section, of a portion of a storage tank and a cathodic protection apparatus.

Turning now to FIG. 1, the bottom portion of a cylindrical metal storage tank is shown and is generally identified by reference numeral 10. As can be seen, the tank bottom 12 is supported by a compacted backfill foundation 14 contained by a footer 16 which lies below the tank perimeter and carries the majority of the tank weight. A containment liner 18 in the form of a plastic sheet or membrane is disposed below the tank bottom 12 within the footer 16. The compacted electrolytic backfill 14 fills the void between the tank bottom 12 and the containment liner 18.

To prevent corrosion of the storage tank 10, a cathodic protection apparatus is provided. As can be seen, the cathodic protection apparatus comprises an anode 32 embedded in the compacted electrolytic backfill 14 between the tank bottom 12 and the containment liner 18. The anode 32 is connected to an above grade rectifier 34 external of the storage tank 10 by a network of feeding cables 36 (see FIG. 2). The feeding cable network 36 extends through a conduit 38 that passes through the footer 16 to a junction box 40. The junction box 40 is connected to the rectifier 34 via main cables 42. In this manner, current is supplied to the anode 32 by the rectifier 34 via the main cables 42, junction box 40 and the feeding cable network 36.

Figure 2:
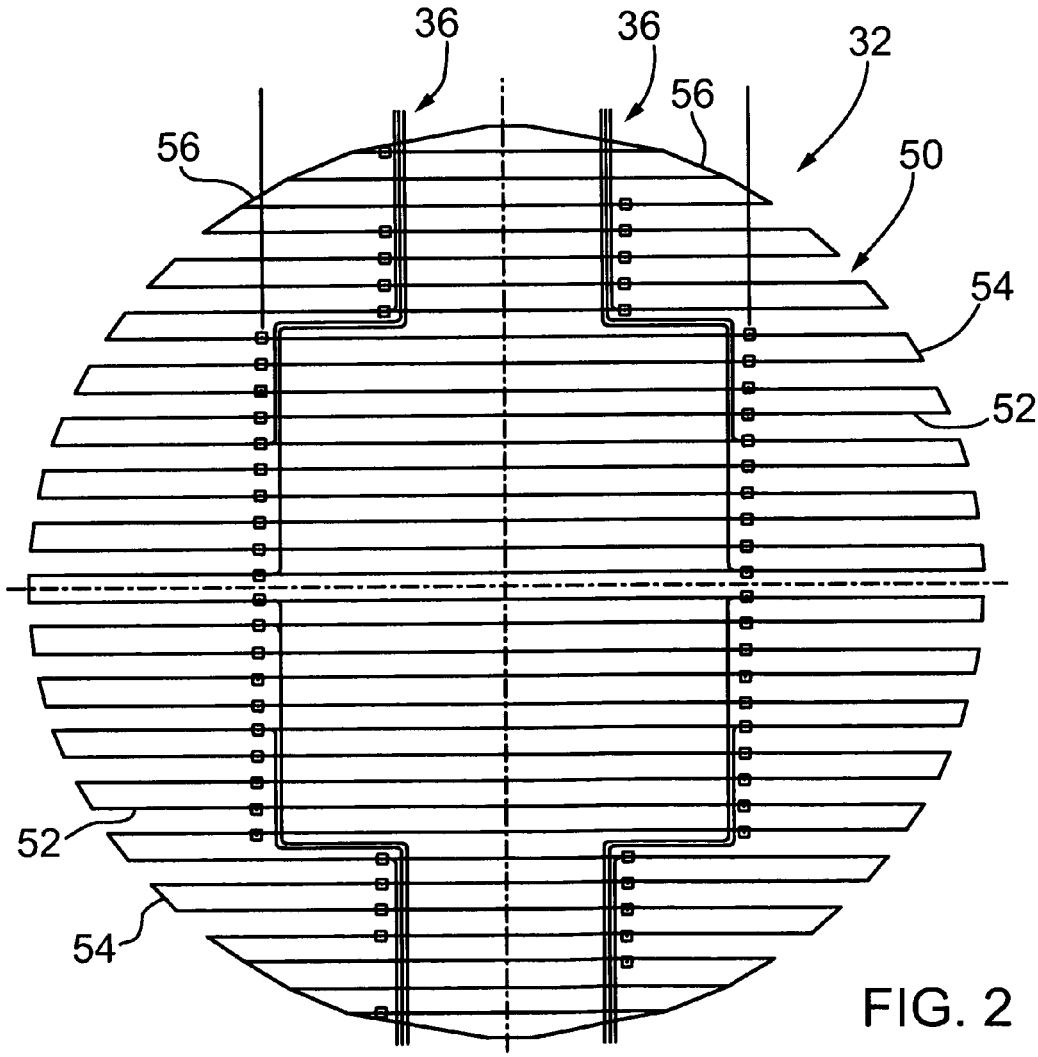
FIG. 2 is a plan view of an anode and a feeding cable network forming part of the cathodic protection apparatus of FIG. 1.
Figure 3:
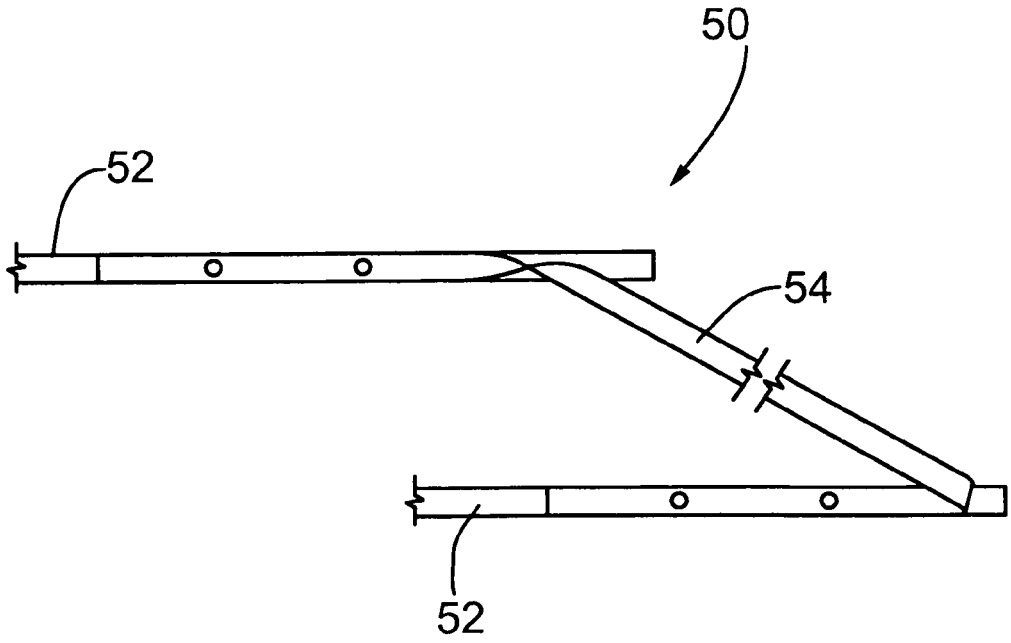
FIG. 3 is an enlarged plan view of a portion of the anode of FIG. 2.

Turning now to FIG. 2, the anode 32 is better illustrated. As can be seen, the anode 32 comprises a bare, continuous mixed metal oxide (MMO) ribbon 50. The ribbon is looped back and forth in a zig-zag or serpentine path corresponding generally to the shape of the storage tank bottom 12 thereby to define major and minor ribbon runs 52 and 54 respectively. If desired, redundant current paths 56 that bridge major ribbon runs 52 in addition to the minor ribbon runs 54 can be provided to ensure current flow through the anode in the event that the ribbon 50 becomes fractured either during installation or operation. In order to loop the ribbon 50, the ribbon is twisted as shown in FIG. 3. In this embodiment, the ribbon 50 has a width of 6.35 mm, a thickness of 0.635 mm and comprises an iridium based mixed metal oxide coated on a Grade I titanium substrate. The anode 32 has a design life of at least 50 years when operating at a current density of 1200 mA/m$^2$.

Figure 4:
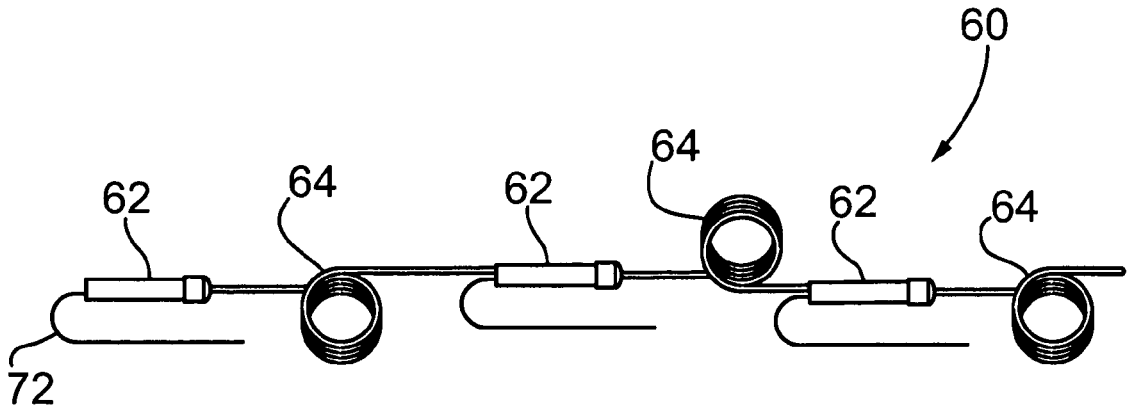
FIG. 4 is a side view of a feeding cable forming part of the feeding cable network of FIG. 2.

As mentioned above, the feeding cable network 36 provides the operating current to the anode 32. In this embodiment, the feeding cable network 36 comprises twelve (12) feeding cables 60, one of which is shown in FIG. 4. Each feeding cable 60 comprises five (5) connectors 62 in series joined by runs of cable 64. Each connector 62 is secured to an associated major ribbon run 52 of the ribbon 50. In this embodiment, the connectors 62 of each feeding cable 60 are connected to consecutive major ribbon runs 52. Thus, each feeding cable 60 supplies operating current to five (5) consecutive major ribbon runs. Two (2) feeding cables 60 are connected to each major ribbon runs 52 at spaced locations. The spacing between the feeding cable connections is selected to achieve a generally uniform current distribution in each major ribbon run 52.

Figure 6:
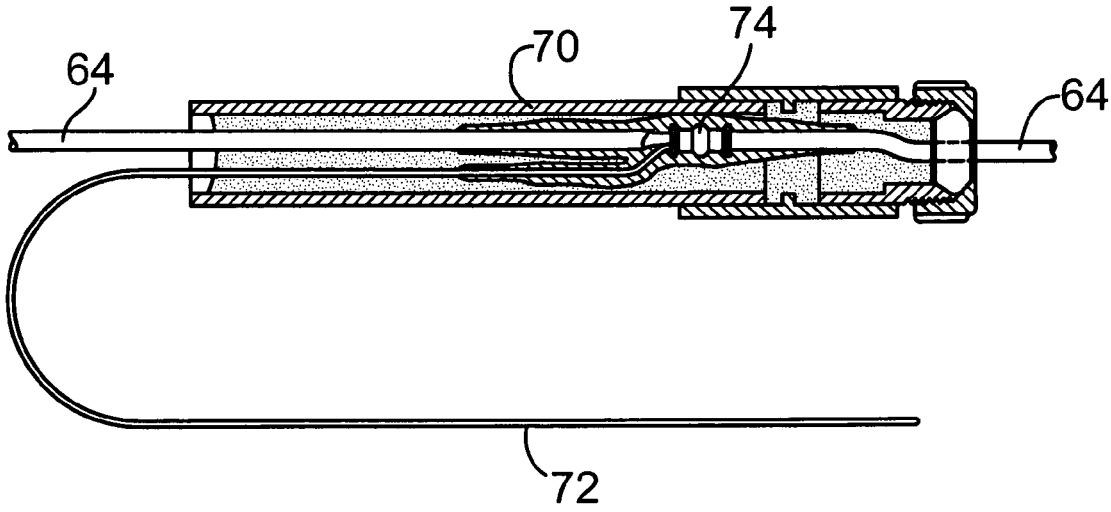
FIG. 6 is a cross-sectional view of the connector of FIG. 5.
Figure 5:
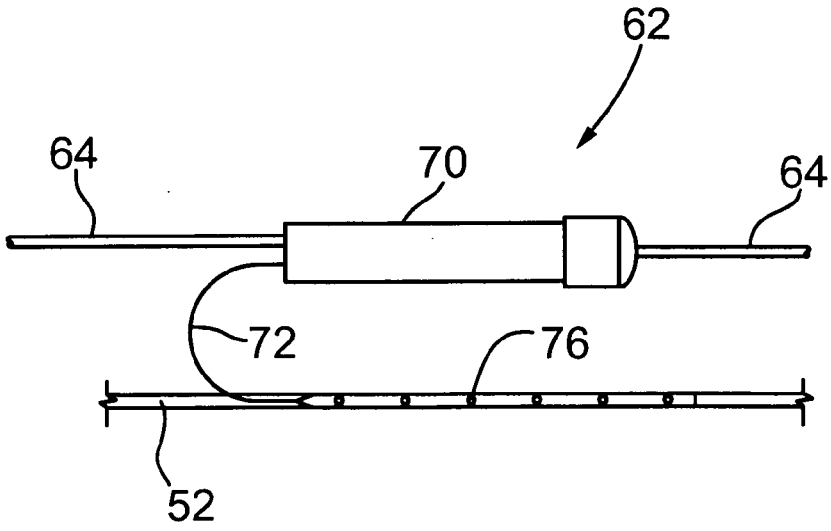
FIG. 5 is an enlarged side view of a connector forming part of the feeding cable of FIG. 4.

As can be seen in FIGS. 5 and 6, the connector 62 comprises an epoxy-filled, capped housing 70 that receives the cable 64. A pigtail 72 is electrically connected at one end to the cable 64 via a compression crimp 74. The pigtail 72 extends out of the housing 70 and is tack welded to its associated ribbon 50 at a plurality of locations 76, in this example at six (6) locations.

Although not shown, the cathodic protection apparatus also comprises a resistivity probe, a monitoring tube and a reference electrode for measurement, monitoring and/or calibration.

The design of the anode 32 and the redundant feeding cable connections ensure that generally uniform current is supplied to the tank bottom 12 and that current continues to flow through the anode 32 in the event that the ribbon 50 becomes fractured either during installation or operation. As a result, the entire tank bottom 12 is cathodically protected thereby preventing corrosion. If desired, redundant current paths that bridge major ribbon runs 52 in addition to the minor ribbon runs 54 can be provided to ensure current flow through the anode 32 in the event that the ribbon 50 of the anode 32 becomes fractured either during installation or operation.

As will be apparent to those of skill in the art, the depth of the anode 32 and the spacing of the major ribbon runs 52 is determined by the protective current demand for the tank bottom 12, the design life of the anode 32, the bulk resistivity of the compacted electrolytic backfill 14, and the calculated current distribution on the tank bottom.

Although the anode ribbon is shown in a configuration that corresponds to the shape of the tank bottom, those of skill in the art will appreciate that other ribbon configurations can be employed. The cathodic protection system can also be used to protect other surfaces from corrosion and is not limited for use with storage tanks.

Although an embodiment has been described above with reference to the figures, those of skill in the art will appreciate that variations and modifications may be made without departing from the spirit and scope thereof as defined by the appended claims.

What is claimed is:

1. A cathodic protection apparatus comprising:

a generally continuous anode to be disposed adjacent a surface to be protected, said anode being in the form of a ribbon that loops back and forth following a generally serpentine path and defines a plurality of generally parallel major ribbon runs and a plurality of minor ribbon runs joining ends of adjacent major ribbon runs;

at least one redundant current path interconnecting a pair of adjacent minor ribbon runs; and a feeding cable network to couple said anode to a source of power.

2. A cathodic protection apparatus according to claim 1 wherein the serpentine path followed by said ribbon is shaped to conform the anode generally to the shape of the surface to be protected.

3. A cathodic protection apparatus according to claim 2 comprising a plurality of redundant current paths, each of the redundant current paths joining a pair of adjacent minor ribbon runs.

4. A cathodic protection apparatus according to claim 3 wherein the redundant current paths are positioned adjacent opposite ends of said ribbon.

5. A cathodic protection apparatus according to claim 3 wherein said feeding cable network is connected to a plurality of major ribbon runs.

6. A cathodic protection apparatus according to claim 5 wherein said feeding cable network is connected to each of the major ribbon runs.

7. A cathodic protection apparatus according to claim 5 wherein said feeding cable network comprises a plurality of feeding cables, each of the feeding cables being connected to a plurality of major ribbon runs, connections of different feeding cables to the same major ribbon run being spaced a distance to achieve generally uniform current distribution in that major ribbon run.

8. A cathodic protection apparatus according to claim 7 wherein each of the feeding cables is connected to a plurality of consecutive major ribbon runs.

9. A cathodic protection apparatus according to claim 7 wherein each of the feeding cables comprises a plurality of connector cables, each connector cable being connected to an associated set of major ribbon runs.

10. A cathodic protection apparatus according to claim 9 wherein said set of the major ribbon runs comprises a plurality of consecutive major ribbon runs.

11. A cathodic protection apparatus according to claim 10 wherein said connector cables comprise pigtails welded to said major ribbon runs.

12. A cathodic protection apparatus according to claim 3 wherein said ribbon is a mixed metal oxide ribbon.

13. In combination, a storage tank having a metal bottom, compacted electrolytic backfill below the tank bottom and a cathodic protection anode within the backfill below the tank bottom, said anode comprising a generally continuous ribbon that loops back and forth following a generally serpentine path corresponding generally in shape to the tank bottom and defines a plurality of generally parallel major ribbon runs and a plurality of minor ribbon runs joining ends of adjacent major ribbon runs and at least one redundant current path interconnecting a pair of adjacent minor ribbon runs.

14. The combination of claim 13 wherein said anode comprises a plurality of redundant current paths, each redundant current path joining a pair of adjacent minor ribbon runs.

15. The combination of claim 14 wherein the redundant current paths are positioned adjacent opposite ends of said ribbon.

16. The combination of claim 14 further comprising a feeding cable network coupling said anode to a power source, said feeding cable network being connected to a plurality of said major ribbon runs.

17. The combination of claim 16 wherein said feeding cable network is connected to each of the major ribbon runs.

18. The combination of claim 16 further wherein said feeding cable network comprises a plurality of feeding cables, each of the feeding cables being connected to a plurality of major ribbon runs, connections of different cables of the feeding cables to the same major ribbon run being spaced a distance to achieve generally uniform current distribution in said major ribbon run.

19. The combination of claim 18 wherein each of the feeding cables comprises a plurality of connector cables, each connector cable being connected to an associated set of major ribbon runs.

20. The combination of claim 19 wherein said set of the major ribbon runs comprises a plurality of consecutive major ribbon runs.

21. The combination of claim 20 wherein said connector cables comprise pigtails welded to said major ribbon runs.

22. The combination of claim 14 wherein said ribbon is a mixed metal oxide ribbon.

23. A cathodic protection apparatus comprising:

an anode to be positioned adjacent a surface to be protected, said anode being in the form of a continuous ribbon that loops back and forth following a generally serpentine path and defines a plurality of generally parallel major ribbon runs and a plurality of minor ribbon runs joining ends of adjacent major ribbon runs, said ribbon undergoing twists during the minor ribbon runs; and a feeding cable network to couple said anode to a source of power.

24. A cathodic protection apparatus according to claim 23 wherein said feeding cable network is connected to a plurality of major ribbon runs.

25. A cathodic protection apparatus according to claim 24 wherein said feeding cable network is connected to each major ribbon run.

26. A cathodic protection apparatus according to claim 23 wherein said feeding cable network comprises a plurality of feeding cables, each of the feeding cables being connected to a plurality of major ribbon runs, connections of different cables of the feeding cables to the same major ribbon run being spaced a distance to achieve generally uniform current distribution in that major ribbon run.

27. A cathodic protection apparatus according to claim 26 wherein each feeding cable is connected to a plurality of consecutive of the major ribbon runs.

28. A cathodic protection apparatus according to claim 26 wherein each of the feeding cables comprises a plurality of connector cables, each of the connector cables being connected to an associated set of major ribbon runs.

29. A cathodic protection apparatus according to claim 28 wherein said set of major ribbon runs comprises a plurality of consecutive major ribbon runs.

30. A cathodic protection apparatus according to claim 29 wherein said connector cables comprise pigtails welded to said major ribbon runs.

31. A cathodic protection apparatus according to claim 23 comprising a plurality of redundant current paths, each of the redundant current paths joining a pair of adjacent minor ribbon runs.

32. A cathodic protection apparatus according to claim 31 wherein the redundant current paths are positioned adjacent opposite ends of said ribbon.

33. In combination, a storage tank having a metal bottom, compacted electrolytic backfill below the tank bottom and a cathodic protection anode within the backfill below the tank bottom, said anode comprising a continuous ribbon that loops back and forth following a generally serpentine path corresponding generally in shape to the tank bottom and defines a plurality of generally parallel major ribbon runs and a plurality of minor ribbon runs joining ends of adjacent major ribbon runs, the ribbon undergoing twists during the minor ribbon runs.

* * * * *